US006168262B1

(12) United States Patent
Clark et al.

(10) Patent No.: US 6,168,262 B1
(45) **Date of Patent: *Jan. 2, 2001**

(54) ELECTRICAL INTERCONNECT FOR REPLACEABLE INK CONTAINERS

(75) Inventors: James E. Clark, Albany; Susan M. Hmelar, Corvallis, both of OR (US); Robert L. Battey, Vancouver, WA (US); Michael L. Bullock, San Diego, CA (US); David O. Merrill, Corvallis, OR (US)

(73) Assignee: Hewlett-Packard Company, Palo Alto, CA (US)

( * ) Notice: This patent issued on a continued prosecution application filed under 37 CFR 1.53(d), and is subject to the twenty year patent term provisions of 35 U.S.C. 154(a)(2).

Under 35 U.S.C. 154(b), the term of this patent shall be extended for 0 days.

(21) Appl. No.: 08/789,958

(22) Filed: Jan. 30, 1997

(51) Int. Cl.[7] ..... B41J 2/14
(52) U.S. Cl. ..... 347/50; 347/86
(58) Field of Search ..... 347/50, 19, 49, 347/86, 87, 65, 4

(56) References Cited

U.S. PATENT DOCUMENTS

| | | | |
|---|---|---|---|
| 4,162,501 | 7/1979 | Mitchell et al. | 346/140 R |
| 4,183,031 | 1/1980 | Kyser et al. | 346/140 R |
| 4,253,103 | 2/1981 | Heinzl et al. | 346/140 R |
| 4,475,116 | 10/1984 | Sicking et al. | 346/140 R |
| 4,511,906 | 4/1985 | Hara | 346/140 R |
| 4,568,954 | 2/1986 | Rosback | 346/140 R |
| 4,737,801 | 4/1988 | Ichihashi et al. | 346/140 R |
| 4,760,409 | 7/1988 | Kiyohara et al. | 346/140 R |
| 4,811,035 | 3/1989 | Huliba et al. | 346/75 |
| 4,831,389 | 5/1989 | Chan | 346/140 R |
| 4,888,602 | 12/1989 | Watanabe et al. | 346/134 |
| 5,162,818 * | 11/1992 | Karita et al. | 347/50 |
| 5,428,498 * | 6/1995 | Hawkins et al. | 347/50 |
| 5,450,110 * | 9/1995 | Sato et al. | 347/65 |

FOREIGN PATENT DOCUMENTS

| | | | |
|---|---|---|---|
| 0789322A2 | 8/1997 | (EP) | G06K 15/00 |

* cited by examiner

*Primary Examiner*—John Barlow
*Assistant Examiner*—Charles W. Stewart, Jr.
(74) *Attorney, Agent, or Firm*—Kevin B. Sullivan

(57) ABSTRACT

The present invention is a replaceable marking media container for use in an off-axis printing system. The printing system includes a printer portion responsive to electrical signals from the replaceable ink container for controlling printer parameters. The replaceable marking media container includes a plurality of electrical contacts with each of the plurality of electrical contacts electrically connected with a memory element. The memory element contains information for controlling printing system parameters. Included in the replaceable ink container a housing having an outer surface facing outwardly and an inner surface. The inner surface defines a cavity within the housing. The plurality of electrical contacts are attached within the cavity, so disposed and arranged, to engage corresponding electrical contacts associated with the printing system. The corresponding electrical contacts associated with the printing system are positioned within the cavity of the marking media container with proper positioning of the marking media container within the off-axis printing system. The use of these electrical contacts allow information to be exchanged between the memory element and the printer.

27 Claims, 5 Drawing Sheets

ELECTRICAL INTERCONNECT FOR REPLACEABLE INK CONTAINERS

CROSS-REFERENCE TO RELATED APPLICATIONS

This application is related to commonly assigned applications filed herewith entitled "Ink Container Configured For Use With Printer", Ser. No. 08/789,959, filed Jan. 30, 1997, and Patent Application entitled "Electrical And Fluidic Interface For An Ink Supply", Ser. No. 08/791,290, filed Jan. 30, 1997, and Patent Application entitled "Ink Container Configured For Use With Compact Supply Station", Ser. No. 08/789,957, filed Jan. 30, 1997, the entire contents of which are incorporated by reference herein.

BACKGROUND OF THE INVENTION

The present invention relates to ink-jet printers that make use of ink containers that are replaceable separate from the printhead. More particularly, the present invention relates to replaceable ink containers which contain a storage device for providing electric signals for controlling printer pararneters.

Previously used ink-jet printers have made use of an ink supply that is either replaced with the printhead as an integral unit or that is replaced separate from the printhead. One type of ink-jet printer in which the supply of ink is replaced separate from the printhead is referred to as an "off-axis" ink delivery system. These off-axis ink delivery systems make use of an ink supply which is spaced from the printhead. The term off-axis refers to positioning of the ink supply relative to the printhead scan axis. In these type of systems images are formed on print media by scanning the printhead across the media as media is advanced. The ink supply is mounted in the printer spaced from the scanning printhead. The ink supply is in fluid communication with the printhead for providing ink to the printhead.

Previously used off-axis ink delivery systems have made use of a memory device located in the ink container for altering the printhead drive conditions based on the information stored in the memory device. For example, U.S. Pat. No. 5,506,611 to Ujita et al discloses the use of a memory device having electric terminals for providing drive conditions to the printhead. These drive conditions include drive voltage, pulse width, frequency, and the number of preliminary discharges. The memory device is mounted to the outer surface of the ink cartridge so that electrical contacts for the memory device are spaced apart on the outer surface of the ink cartridge. As the ink cartridge is inserted into the inkjet printer, electric terminals associated with the bubble-jet printer slidingly contact the spaced apart electric terminals associated with the ink cartridge.

One problem associated with the use of electrical contacts or terminals positioned on the outer portion of the ink cartridge is that these electrical contacts are subject to contamination. Contamination can result from the handling of the ink cartridge or ink spillage from the fluid interconnect. Contamination from handling includes hand oils and salts which are frequently present in human skin. This contamination may be transferred to the electrical contacts associated with the printer. One particular contamination problem is the combination of dust and hand oils. Contamination of the electrical contacts can result in unreliable electrical contact between the ink cartridge and the printer resulting in system reliability problems. Furthermore, the use of electrical contacts on the outer surface of the ink cartridge makes these terminals susceptible to liquid contamination such as moisture or spilled ink. Liquid contaminates can result in the shorting of these electrical contacts resulting in a faulty electrical interconnect and possibly system failure. Furthermore, inks used for ink-jet printing typically make use of solvents and surfactants which over time can result in corrosion of the electrical contacts preventing proper electrical contact between the printer and ink container.

Another problem associated with the use of electrical contacts or terminals positioned on the outer portion of the ink cartridge is that these contacts are subject to mechanical damage to the contacts such as scraping, denting or pealing, to name a few. This damage, if sufficient, may result in reliability problems or failure of the electrical interconnect between the printer and ink container.

Still another problem associated with the use of electrical terminals positioned on the outer portion of the ink cartridge is that these terminals subject the storage device to electrostatic discharge (ESD). Electrostatic discharge results from the electric terminals contacting a charged surface resulting in a discharge through the storage device. This discharge can result in catastrophic failure or reduce lifetime or reliability of the storage device. Storage devices such as CMOS semiconductor devices are particularly susceptible to electrostatic discharge damage.

There is an ever present need for printing systems which are capable of providing low operating costs such as printers which make use of off-axis type ink supplies. In addition, these printing systems should be easy to operate, such as, including some form of memory for storing printing parameters so that the user is not required to adjust printer parameters when the ink container is replaced. These ink supplies should be capable of reliable insertion into the printing system to ensure proper fluid interconnection and proper electrical interconnection with the printer is achieved. In addition, these interconnections should be reliable and should not degrade over time and use. For example, the fluid interconnect should not leak during use or over time and the electrical interconnect should be reliable during use and over time. In addition, these ink cartridges should not require special handling by the user and should be reliable and easily connected by the user to form a positive highly reliable mechanical, electrical, and fluid interconnect with the printer.

Finally, electrical interconnection between the ink container and printer should be reliable without requiring relatively large contact force. The use of relatively large contact force tends to improve the reliability of the electrical interconnect. Large contact force interconnects tend to require increased latch and insertion forces which tend to result in increased costs due to higher force latch springs and larger latching surfaces. Therefore, the electrical interconnect should be capable of providing high reliability and requiring relatively low interconnect forces.

SUMMARY OF THE INVENTION

The present invention is a replaceable ink container for use in an off-axis printing system. The printing system includes a printer portion responsive to electrical signals from the replaceable ink container for controlling printer parameters. The replaceable ink container includes a plurality of electrical contacts with each of the plurality of electrical contacts electrically connected with a memory element. The memory element contains information for controlling printing system parameters. Included in the replaceable ink container is a housing having an outer surface facing outwardly and an inner surface. The inner surface defines a cavity within the housing. The plurality of electrical contacts are so disposed and arranged within the cavity to engage corresponding electrical contacts associated with the printing system. The corresponding electrical contacts associated with the printing system are positioned within the cavity of the marking media container to engage the plurality of electrical contacts associated with the replaceable ink container upon proper positioning of the marking media container within the off-axis printing system. The use of these electrical contacts allow information to be exchanged between the memory element and the printer.

DETAILED DESCRIPTION OF THE PREFERRED EMBODIMENT

Figure 1:
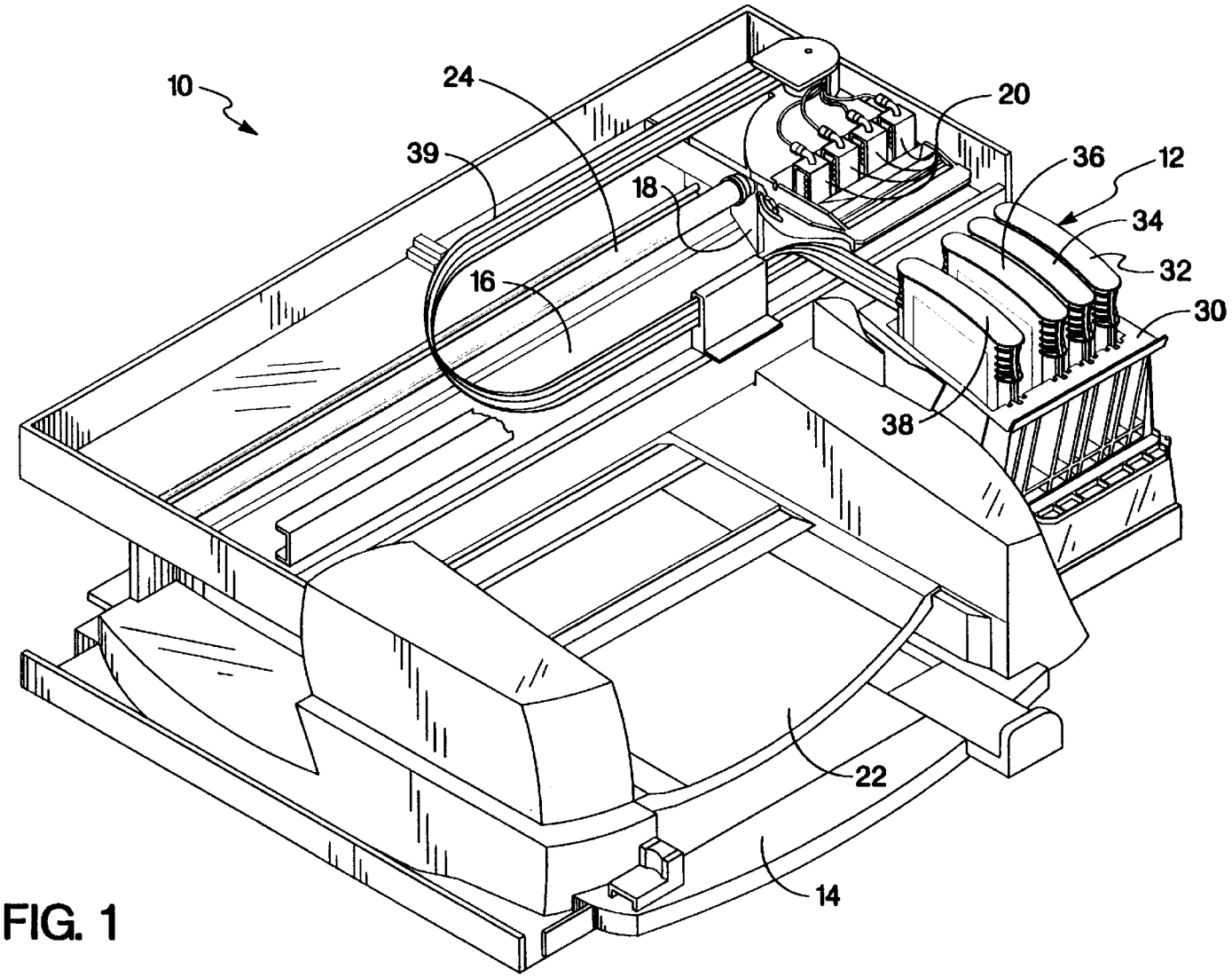
FIG. 1 is a perspective view of an ink-jet printer (with cover removed), which incorporates the ink container of the present invention.

FIG. 1 depicts a perspective view of one embodiment of an ink-jet printer 10, with its cover removed, containing one or more ink containers 12 which incorporate a plurality of electrical contacts disposed within a cavity which is the subject of the present invention. The present invention makes use of electrical contacts which are disposed within a cavity which tends to reduce or eliminate contamination or mechanical damage to the electrical contacts which tends to improve the reliability of the electrical interconnect between the ink-jet printer 10 and the ink container 12.

The electrical contacts of the present invention allow for the exchange of information between the printer 10 and the ink container 12. With the new varieties of inks and media it becomes increasingly important for the printer to compensate for these different inks and media. The use of an electrical storage device located with the ink container 12 allows the printer 10 to read the information from the storage device and compensate for the particular ink installed in the printer 10. Therefore, the use of a memory device that is associated with the ink container 12 greatly increases the printers 10 ease of use and ensures the highest quality output image provided the electrical interconnect is reliable. In addition, to compensate for ink used, the storage device in the ink container 12 may provide a wide variety of other functions such as providing usage data, calibration data, consumption data, and maintenance information, to name a few.

The printer 10 includes a tray 14 for holding a paper supply. When a printing operation is initiated a sheet of paper from tray 14 is feed into printer 10 using a sheet feeder (not shown). During printing the paper passes through a print zone 16 whereupon a scanning carriage 18, containing one or more printheads 20, is scanned across the sheet for printing a swath of ink thereon. The sheet of paper is stepped through the print zone 16 as the carriage 18 prints a series of swaths of ink to form images thereon.

After printing is complete, the sheet is positioned into an output tray 22. The positioning of the paper supply 14 and the output tray 22 relative to the print zone 16 can vary depending on the particular sheet feed mechanism used.

The carriage 18 moves through the print zone 16 on a scanning mechanism which includes a slide rod 24 on which the carriage 18 slides. A positioning device such as a coded strip and a photo detector in the carriage 18 is used for precisely positioning the carriage 18. A stepper motor (not shown), connected to the carriage 18 using a conventional drive belt and pulley arrangement, is used for transporting the carriage 18 across the print zone 16.

A ribbon cable carries electrical signals to the carriage 18 for selectively energizing the printheads 20. As the ink printheads 20 are selectively energized, ink of a selected color is ejected onto the print media as the carriage 18 passes through the print zone 16.

The present invention relates to the ink containers 12 which provide ink to the printheads 20 for ejection onto print media. The ink containers 12 are referred to as off-axis ink supplies because the ink containers 12 are spaced from a scan axis along which the printheads 20 are scanned. This off-axis ink delivery system includes an ink supply station 30, for receiving each of the individual ink containers 32, 34, 36, and 38. These ink containers 32, 34, 36, and 38 in the case of color printers typically are an ink container for black ink, yellow ink, magenta ink, and cyan ink. The supply station 30 contains a mechanical interface, a fluid interface, and an electrical interface so that when the proper ink containers 32, 34, 36, and 38 are inserted into the supply station 30 the ink container is mechanically latched into place and electrical and fluid interfaces are accomplished with the printer 10. Fluid passes from the ink container 12 through these fluid interfaces to the supply station 30 and then through four tubes 39 which fluidicly connect the individual ink containers 32, 34, 36, and 38 with corresponding printheads 20 on the print carriage 18.

Figure 2:
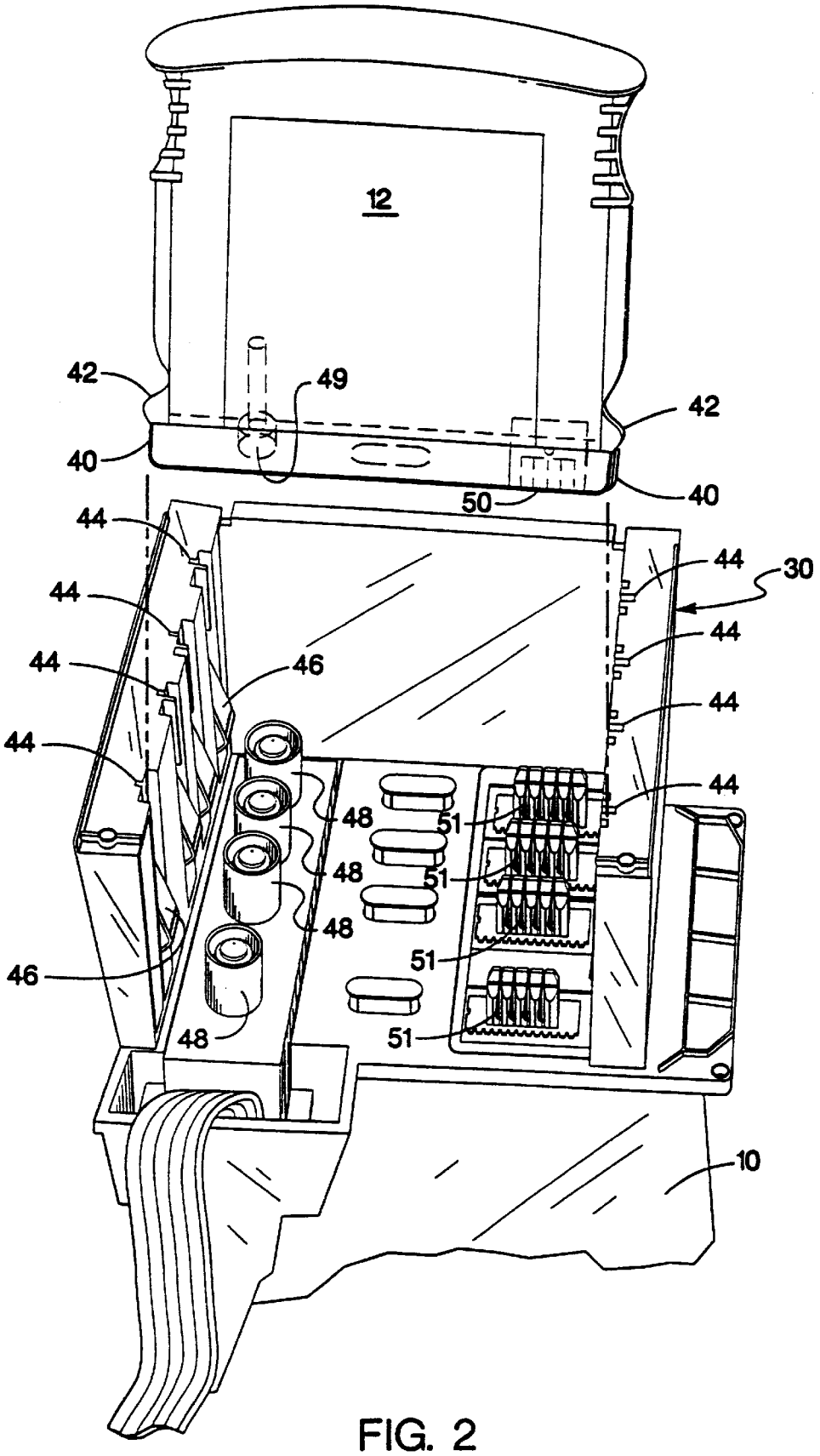
FIG. 2 is a perspective view of an ink supply receiving station of the type used in the ink-jet printer of FIG. 1 shown in broken away with an ink supply positioned for insertion into the ink supply receiving station.

FIG. 2 depicts an ink container 12 of the present invention positioned for insertion into the supply station 30 of printer 10. The ink container 12 contains a supply of a media marking fluid such as ink. Also included in the ink container 12 are a fluid outlet 49, a plurality of electrical contacts 50, aligning features 40 and latching features 42. The aligning features 40 on the ink container 12 assist in aligning the ink container 12 during insertion of the ink container 12 into the supply station 30. The aligning features 40 work in conjunction with corresponding aligning features 44 on the supply station 30. The aligning features 40 and 44 in addition, provide keying functions to ensure that only ink container 12 having proper parameters such as proper color and ink type is inserted into printer 10. Keying features are discussed in more detail in co-pending U.S. patent application Ser. No. 08/566,521 filed Dec. 4, 1995 entitled "Keying System For Ink Supply Containers" assigned to the assignee of the present invention and incorporated herein by reference.

Once the proper ink container 12 is properly aligned and inserted into the supply station 30, a latching feature 46 engages the corresponding latching feature 42 on the ink container 12 to latch the ink container 12 into the supply station 30. With the ink container 12 properly latched into the supply station 30, a fluid inlet 48 associated with the supply station 30 engages the corresponding fluid outlet 49 on the ink container 12 to allow media marking fluid to flow from the ink container 12 to the printer 10 and ultimately the printheads 20 for depositing ink on print media. In one preferred embodiment, the engagement of the latching features 42 and 46 occurs at approximately the same time as the supply station 30 engages the corresponding fluid outlet 49 to allow fluid flow from the ink container 12 to the printer 10.

Insertion of the ink container 12 into the supply station 30 forms an electrical interconnect between the ink container 12 and the supply station 30 which is the subject of the present invention. The electrical contacts 50 associated with the ink container 12 engage corresponding electrical contacts 51 associated with the supply station 30 to allow information to be transferred between the supply station 30 and the ink container 12. It is the positioning and orientation of these electrical contacts on the ink container 12 that allow a highly reliable electrical contact to be formed between the supply station 30 and the ink container 12.

Figure 3D:
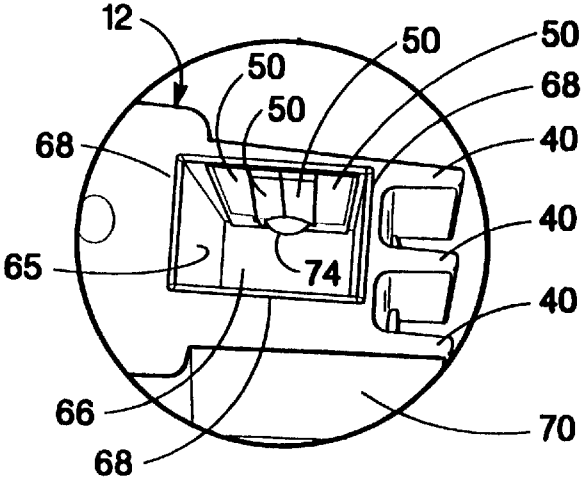
FIGS. 3*a*, 3*b*, and 3*c* and 3*d* is an isometric view of the ink container of the present invention with the electrical interconnect portion shown greatly enlarged.
Figure 3B:
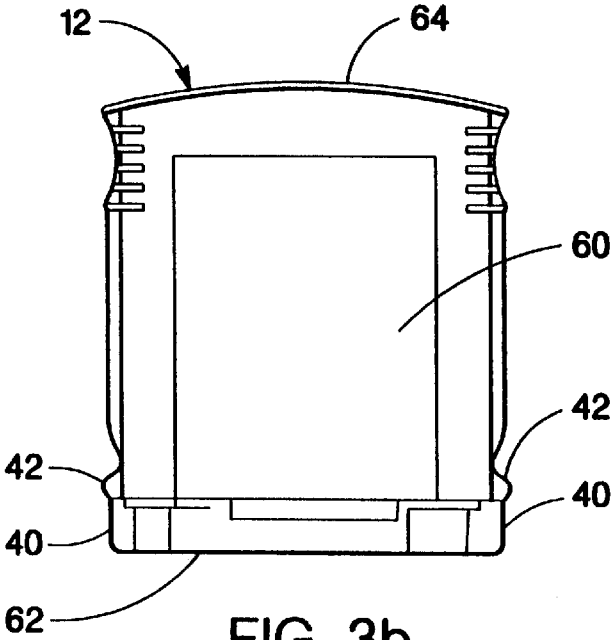
Figure 3C:
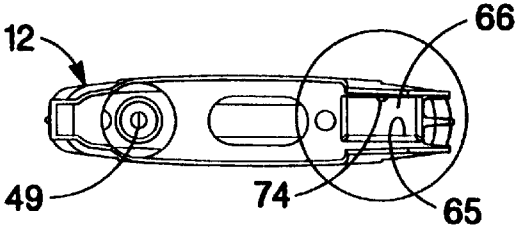
Figure 3A:
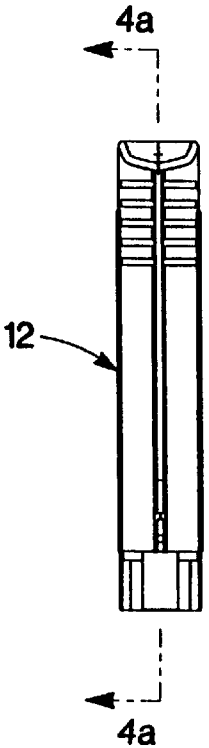

FIGS. 3*a*, 3*b*, and 3*c* depict isometric views of one preferred ink container 12 of the present invention. The ink container 12 includes an outer surface or housing 60 having a leading edge 62 and a trailing edge 64 relative to the direction of insertion of the ink container 12 into the supply station 30. The ink container 12 has an inner surface 65 which defines a cavity 66. The outer surface 60 defines a rectangular opening 70 into the cavity 66 at the leading edge 62 of the ink container 12. In one preferred embodiment the outer surface 60 of the ink container has beveled edges 68 which at least partially surround the opening 70.

FIG. 3*d* depicts an enlarged perspective view of the cavity 66 shown in FIG. 3*c*. A memory device 74 such as a semiconductor memory is disposed on the inner surface 65 of the cavity 66. The memory device 74 is electrically connected to each of the plurality of electrical contacts 50. The electrical contacts 50 are configured for engagement with corresponding electrical contacts 51 associated with the supply station 30.

In this preferred embodiment the opening 70 to the cavity 66 is sized to be small enough to prevent fingers from entering the cavity 66 thereby eliminating or reducing the possibility of inadvertent finger insertion into the cavity 66. The proper sizing of the opening 70 is critical for preventing contamination or physical damage to the electrical contacts 50 associated with the memory device 74 resulting from the handling of the ink container 12. Placement of the electrical contacts 50 within the cavity 66 tends to prevent dust from settling on the contact surface. Dust which accumulates on the electrical contacts 50 can prevent the electrical contacts 50 from reliably electrically engaging electrical contacts 51.

The fluid outlet 49 is positioned on the leading edge 62 of the ink container 12 opposite and spaced from the cavity 66. The fluid outlet 49 is configured for engaging the corresponding fluid inlet 48 associated with the supply station 30 for allowing fluid to pass from the ink container 12 to the supply station 30. It is important that the fluid outlet 49 is spaced from the plurality of electrical contacts 50 to minimize the opportunity for ink leakage from the fluid outlet 49 from contaminating the electrical contacts 50. In this preferred embodiment the fluid outlet 49 and the electrical contacts 50 are placed toward opposite ends of the leading edge 62 of the ink container 12. Placement of the electrical contacts 50 within the cavity 66 in a spaced relationship from the ink outlet 49 eliminates or greatly reduces the opportunity for contamination of the electrical contacts. This contamination results from ink that is either leaked from the outlet or is spattered during the connection or disconnection of the fluid outlet 49 and fluid inlet 48 as ink containers 12 are removed and inserted into the printer 10.

Figure 4A:
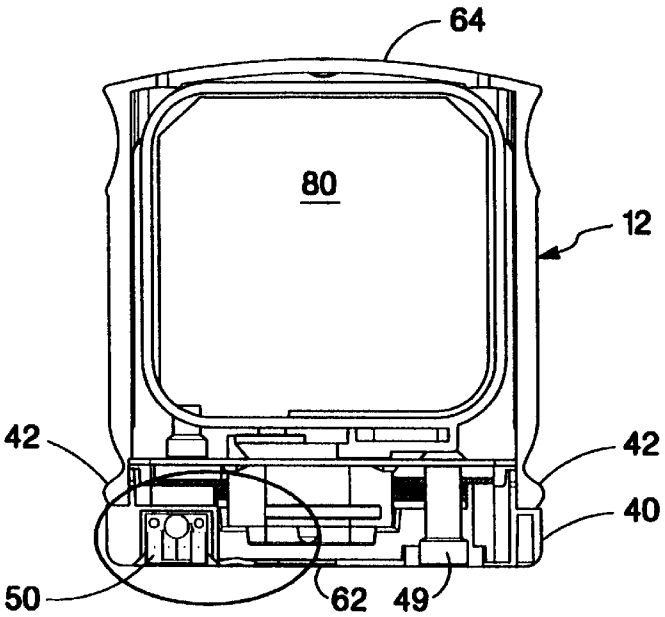
FIGS. 4*a* and 4*b* is the ink supply of the present invention shown in a section view taken along line 4*a*—4*a* in FIG. 3*a*.

FIG. 4*a* depicts a sectional view of the ink container 12 taken across section line 4*a*—4*a*. The ink container 12 includes an ink reservoir 80, fluid outlet 49, electrical contacts 50, and the electrical storage device 74. The ink reservoir 80 allows ink to pass through the fluid outlet 49 into corresponding fluid inlet 48 of the supply station 30. The ink container 12 may be of the type which includes some form of pump or pressurization scheme often used where high flow rate are required or may be a non-pressurized system where gravity or capillary force ensures ink flow between the ink reservoir 80 and the printer 10.

Figure 4B:
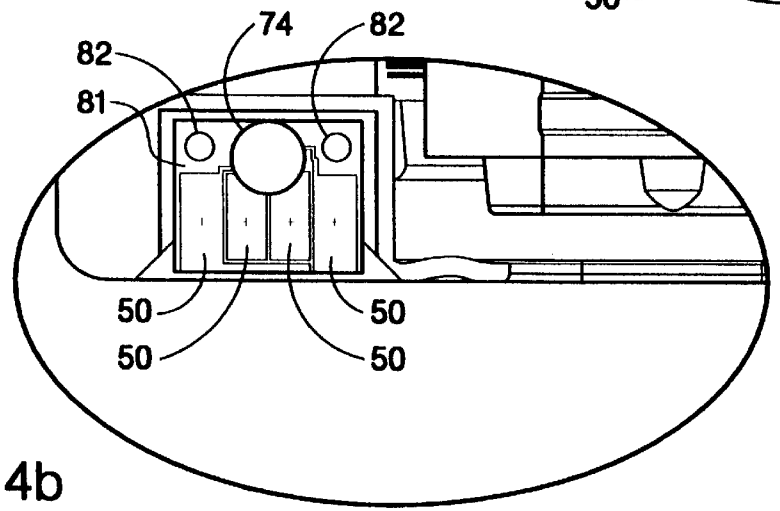

FIG. 4*b* depicts a greatly enlarged view of the memory device 74 and electrical contacts 50. In one preferred embodiment the memory device 74 and the electrical contacts 50 are mounted on a substrate 81. An adhesive is used to mount the substrate 81 to the inner surface 65 of the cavity 66 such that the electrical contacts 50 are facing into the cavity 66. Tooling holes 82 are provided in the substrate 81 to insure proper alignment of the substrate 81 during mounting. Each of the electrical contacts 50 are electrically isolated from each other by the substrate 81. In addition, each of the electrical contacts 50 are electrically connected to the electric storage device 74.

In one preferred embodiment the electrical contacts 50 represent contacts for power and ground connections as well as a clock signal and a data signal connection. Proper insertion of the ink container 12 into the printer 10 allows the electrical contacts 51 associated with the printer 10 to engage electrical contacts 50 associated with the ink container 12 forming an electrical interface between printer 10 and ink container 12. With power and ground applied to the storage device 74 data is transferred between the printer 10 and ink container 12 at a rate stabilized by the clock signal. It is critical that the electrical connection between the printer 10 and the ink container 12 formed by electrical contacts 50 and 51 be low resistance connections to ensure reliable data transfer. If the electrical contacts 50 and 51 fail to provide a low resistance connection, for example because of contamination on either of these contacts, then data may not be properly transferred or the data transferred may be corrupted or not accurate. Therefore, it is critical that a reliable, low resistance connection is made between the printer 10 and the ink container 12 to ensure proper transfer of data.

Figure 5:
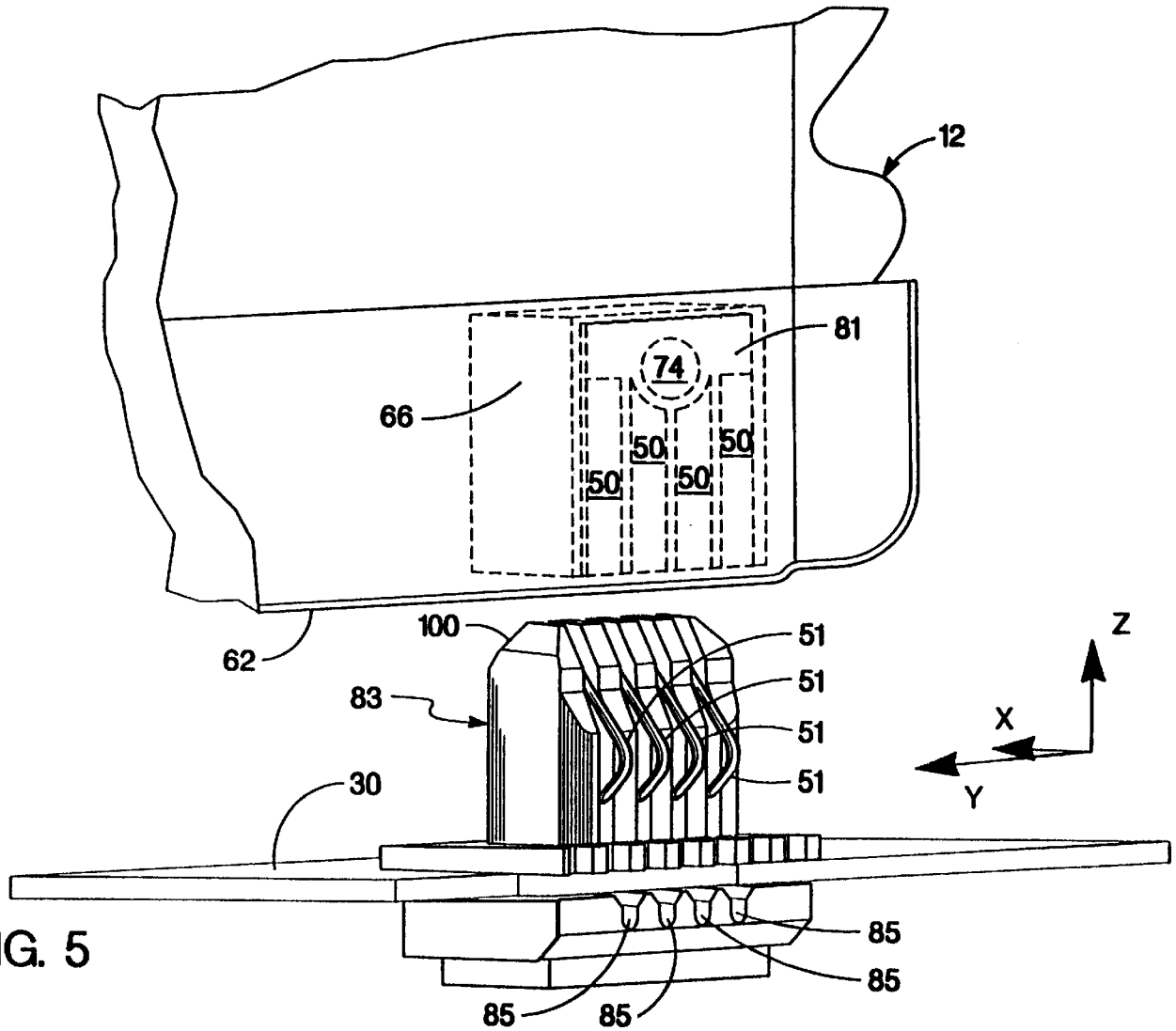
FIG. 5 shows a greatly enlarged perspective view of the electrical interface between the ink container of the present invention and the ink supply station portion of the ink-jet printer shown partially broken away.

FIG. 5 depicts a greatly enlarged perspective view, shown partially broken away, of the ink container 12 positioned for insertion onto the electrical contacts 51 associated with the ink supply station 30. The cavity 66 that is positioned at the leading edge 62 of the ink container 12 is represented by dotted lines. Also shown in dotted lines is the substrate 81, electrical contacts 50, and memory device 74, each of which are positioned within the cavity 66.

The electrical contacts 51 associated with the supply station 30 are mounted on an electrical connector 83. The electrical connector 83 has a tapered leading edge portion 100 which engages the beveled opening 68 on the leading edge 62 of the ink container 12 to guide the electrical connector 83 into the cavity 66. The electrical connector 83 has the electrical contacts 51 spring biased outwardly from the electrical connector 83. As the ink container 12 is inserted into the printer 10 the electrical contacts 51 are compressed to bias against the electrical contacts 50 on the inner wall of the cavity 66 to form a low resistance electrical connection between the printer 10 and electrical contacts 50 which are electrically connected to the memory 74. The electrical contacts 51 are each electrically connected to electrical terminals 85 which are electrically connected to the printer 10.

In one preferred embodiment, the entire electrical connector 83 associated with the supply station 30 is floating in the two dimensions orthogonal to the direction of ink container 12 insertion. The Z axis in the coordinate system shown represents the direction of ink container 12 insertion. The X and Y axis representing the directions of freedom for the electrical connector 83 during the ink container 12 insertion. During insertion of the ink container 12 into the supply station 30, the tapered leading edge 100 of the electrical connector 83 engages the opening 70 of the cavity 66. As the ink container 12 is further inserted into the supply station 30, the electrical connector 83 is free to move along the X and Y axis to properly align with the cavity 66. The electrical spring contacts 51 engage and are biased against the electrical contacts 50 of the ink container 12. In this manner, reliable electrical contact between the ink container 12 and the supply station 30 is assured. In one preferred embodiment the electrical contacts 50 engage the spring contacts 51 with an engagement force of approximately 90 grams per lead. In another preferred embodiment the tapered leading edge 100 extends approximately 3 millimeters beyond an engagement surface of the spring contacts 51.

The tapered leading edge 100 of the electrical connector 83 together with the beveled edges at the opening 68 of the cavity 66 allows for misalignment between the opening 68 and the tapered leading edge 100. This tolerance for misalignment is important, since in order to provide a low cost printer, all of the associated printer 10 parts are formed of plastic which must be molded at reasonable cost. Such molded plastic parts often have dimensional variations that result in variation in the initial alignment between the ink container 12 and the supply station 30. In addition, the electrical connector 83 floats in x and y axis which increases the variability of the initial positioning of the connector 83 before the ink container 12 insertion takes place. This floating connector 83 further increases the need for having alignment-tolerant lead-in features. It is the alignment tolerant features together with the aligning features 40 and 44 on the ink container 12 and supply station 30, respectively, that provide for reliable insertion of the ink container 12 into the printer 10.

Although one of the preferred embodiments of the present invention makes use of a memory device 74 that requires four electrical contacts 50, memory devices having fewer or greater numbers of electrical contacts 50 may also be used. In addition, this preferred embodiment of the present invention makes use of the electrical contacts 50 which are positioned on the same inner surface within the cavity 66. The electrical contacts 50 may also be positioned on other inner surfaces within the cavity 66 as well.

In the preferred embodiment, the electrical contacts 50 are positioned on an inner surface within cavity 66. Alternatively, the electrical contacts 50 can be positioned on an inner surface of one or more upstanding walls which extend from the ink container 12 along the insertion direction (z axis). In this case, the upstanding walls, at least partially, define a cavity 66. Positioning the electrical contacts 50 on the inward facing surfaces of the upstanding walls prevents or limits the exposure of the contacts 50 to sources of contamination.

The present invention provides a reliable electrical interconnect between the ink container 12 and the ink supply station 30. The positioning of the electrical contacts 50 on the leading edge 62 of the ink container 12 simplifies the mechanical interface between the ink container 12 and the supply station 30. In addition, the positioning of the electrical contacts 50 in a spaced relationship from the ink outlet 49 and within the cavity 66 on the leading edge of the ink container 12 helps minimize the risk of contamination of the contacts either by ink which may short the electrical contacts or other forms of contamination such as the handling of the ink container 12 prior to insertion into the printer 10. Contamination due to handling of the ink container 12 can be particularly insidious because this contamination can transfer from the ink container electrical contacts 50 to the electrical contacts 51 associated with the printer 10 in which case simply replacing the ink container 12 may not remedy the problem.

What is claimed is:

1. A replaceable ink container for use in an off-axis printing system, the off-axis printing system including a stationary ink container station for receiving the replaceable ink container, a printer portion spaced from and movable, along a scan axis, relative to the ink container station, and a system for fluidicly and electrically coupling the ink container station to the printer portion, wherein the printer portion is responsive to electrical signals from the replaceable ink container for controlling printing system parameters, the replaceable ink container comprising:

a memory element;

a plurality of electrical contacts with each of the plurality of electrical contacts electrically connected with the memory element, the memory element storing information and producing electrical signals for controlling printing system parameters; and a housing having an outer surface facing outwardly and an inner surface, the inner surface forming a wall defining a cavity within the housing, the plurality of electrical contacts being attached within the cavity to the wall such that the plurality of electrical contacts within the cavity engage a corresponding plurality of electrical contacts associated with the ink container station, wherein the corresponding plurality of electrical contacts are positioned within the cavity of the ink container housing upon insertion of the replaceable ink container into the ink container station, insertion of the replaceable ink container into the ink container station necessitating only substantially linear movement of the ink container from initial contact of the replaceable ink container with the ink container station through complete and full engagement of the replaceable ink container with the ink container station of the off-axis printing system, the engagement of the plurality of electrical contacts with the corresponding plurality of electrical contacts allowing the memory device to provide the printer portion with the electrical signals providing information for controlling printing system parameters.

2. The replaceable ink container of claim 1 wherein the memory element is a semiconductor memory device.

3. The replaceable ink container of claim 1 wherein the housing further includes a supply of ink contained within the housing.

4. The replaceable ink container of claim 1 wherein the housing has a leading edge, the leading edge being defined as that edge of the housing first received by the ink container station upon proper insertion of the replaceable ink container into the ink container station of the off-axis printing system, the cavity containing the plurality of electrical contacts being disposed toward the leading edge of the replaceable ink container.

5. The replaceable ink container of claim 4 wherein the outer surface of the replaceable ink container includes an opening for the cavity, and wherein the opening is disposed along the leading edge of the replaceable ink container.

6. The replaceable ink container of claim 5 wherein the opening is rectangular.

7. The replaceable ink container of claim 1 wherein the wall defining the cavity includes a plurality of wall portions with one wall portion of the plurality of wall portions having a planar surface, and wherein the memory element is attached to the planar surface.

8. The replaceable ink container of claim 7 wherein another wall portion of the plurality of wall portions has a second planar surface, and wherein the second planar surface is parallel to, and spaced from, the planar surface on which the memory clement is attached.

9. The replaceable ink container of claim 1 wherein the plurality of electrical contacts are attached to the wall defining the cavity so as to face in a direction orthogonal to the wall.

10. An off-axis printing system for forming images on media, the off-axis printing system comprising:

a printing portion movable along a scan axis for forming images on media, the printing portion being responsive to electrical signals that control printing parameters of the printing portion;

an ink container station spaced from and immovable with the printing portion, the ink container station having a projecting portion, the projecting portion having a plurality of electrical contacts disposed thereon;

a system for fluidicly and electrically coupling the ink container station to the printing portion; and a replaceable ink container releasably engaged with the ink container station for delivering ink to the printing portion through the coupling system, the replaceable ink container including:

a memory element for storing information and producing the electrical signals for controlling printing parameters of the printing portion, the memory element having a plurality of electrical contacts associated therewith, the plurality of electrical contacts of the memory element being electrically connected with the memory element; and a housing having an outer surface facing outwardly and an inner surface, the inner surface forming a wall defining a cavity within the housing, the memory element being attached within the cavity to the wall, the plurality of electrical contacts of the memory clement engaging the corresponding plurality of electrical contacts of the projecting portion when the projecting portion is positioned within the cavity of the housing upon insertion of the replaceable ink container into the ink container station insertion of the replaceable ink container into the ink container station necessitating only substantially linear movement of the replaceable ink container from initial contact of the replaceable ink container with the ink container station through complete and full engagement of the replaceable ink container with the ink container station of the off-axis printing system, the engagement of the plurality of electrical contacts with the corresponding plurality of electrical contacts allowing the memory element to provide the printing portion, through the coupling system, with the electrical signals for controlling printing parameters of the printing portion.

11. The off-axis printing system of claim 10 wherein the memory element is a semiconductor memory device.

12. The of-axis printing system of claim 10 wherein the housing further includes a supply of ink contained within the housing from which the ink is delivered to the printing portion.

13. The off-axis printing system of claim 10 wherein the housing has a leading edge, the leading edge being defined as that edge of the housing first received by the ink container station upon proper insertion of the replaceable ink container into the ink container station of the printing system, the cavity containing the memory element being disposed toward the leading edge of the replaceable ink container.

14. The off-axis printing system of claim 13 wherein the outer surface of the replaceable ink container includes an opening for the cavity, and wherein the opening is disposed along the leading edge of the replaceable ink container.

15. The off-axis printing system of claim 14 wherein the projecting portion has a shape that is complimentary with the opening for the cavity.

16. The off-axis printing system of claim 14 wherein the opening is rectangular.

17. The off-axis printing system of claim 10 wherein the wall defining the cavity includes a plurality of wall portions with one wall portion of the plurality of wall portions having a planar surface and wherein the memory element is attached to the planar surface.

18. The off-axis printing system of claim 17 wherein another wall portion of the plurality of wall portions has a second planar surface, and wherein the second planar surface is parallel to, and spaced from, the planar surface on which the memory element is attached.

19. A method for inserting an ink container having an electric storage device therein into an off-axis printing system of the type including a stationary ink container station for receiving the ink container, a printer portion spaced from and movable, along a scan axis, relative to the ink container station, and a system for fluidicly and electrically coupling the ink container station to the printer portion, the method comprising steps of:

urging the ink container into the ink container station of the off-axis printing system using only substantially linear movement of the ink container form initial contact of the ink container with the ink container station through complete and full engagement of the ink container with the ink container station, the ink container having an outer surface that defines an opening to a recess within the outer surface, the recess being defined by a plurality of walls and the opening having a shape corresponding to a movable projection element associated with the ink container station, the opening engaging the projection element and urging the movable projection element into alignment with the opening; and engaging electrical contacts disposed on the projection element with corresponding electrical contacts disposed within the recess.

20. The method for inserting an ink container of claim 19 further including transferring information between the printer portion and the ink container by way of the engaging of electrical contacts disposed on the projection element with electrical contacts disposed within the recess.

21. The method for inserting an ink container of claim 20 wherein transferring information between the printer portion and ink container includes providing a signal indicative of printing parameters from the ink container to the printer portion.

22. The method for inserting an ink container of claim 19 further including fluidicly connecting the ink container with the ink container station of the off-axis printing system.

23. A replaceable ink container adapted to be releasably installed into an off-axis printing system, the off-axis printing system including a stationary ink container station for receiving the replaceable ink container, a printer portion spaced from and movable, along a scan axis, relative to the ink container station, and a system for fluidicly and electrically coupling the ink container station to the printer portion, wherein the printer portion is responsive to electrical signals from the replaceable ink container for controlling printing system parameters, the replaceable ink container comprising:

a memory element;

a plurality of container electrical contacts, each of the plurality of contacts electrically connected to the memory element, the memory element storing information and producing electrical signals for controlling printing system parameters; and an ink container housing having the plurality of container electrical contacts disposed thereon to engage a plurality of corresponding system electrical contacts, the plurality of system electrical contacts being supported by a connector body that has a degree of movement such that the connector body can move in a direction perpendicular to an insertion axis along which the replaceable ink container is inserted into the ink container station, insertion of the replaceable ink container into the ink container station necessitating only substantially linear movement of the replaceable ink container alone the insertion axis from initial contact of the replaceable ink container with the ink container station through complete and full engagement of the replaceable ink container with the ink container station, the degree of movement of the connector body allowing for a placement tolerance variation of the plurality of container electrical contacts relative to the plurality of system electrical contacts, wherein the ink container housing has a leading edge surface defined as that surface of the ink container housing first received by the ink container station upon proper insertion of the replaceable ink container into the ink container station, the connector body extending beyond the leading edge surface to allow proper positioning of the plurality of container electrical contacts relative to the plurality of system electrical contacts when the replaceable ink container is properly positioned within the ink container station.

24. The replaceable ink container of claim 23 wherein the plurality of system electrical contacts are a plurality of spring electrical contacts that exhibit a spring force, and wherein the ink container housing imparts a force to the connector body that opposes the spring force exerted by the plurality of spring electrical contacts.

25. The replaceable ink container of claim 24 wherein the ink container housing has a short axis that is perpendicular to the insertion axis, and wherein the spring force exerted by the plurality of spring electrical contacts is directed along the short axis.

26. The replaceable ink container of claim 23 wherein the ink container housing includes a substantially planar contact surface to which the plurality of container electrical contacts are attached.

27. The replaceable ink container of claim 23 wherein the contact surface is substantially aligned with the insertion axis.

* * * * *